US012628894B1

(12) United States Patent
Fang

(10) Patent No.: US 12,628,894 B1
(45) Date of Patent: May 19, 2026

(54) CRAFT FLOWER

(71) Applicant: Weitao Fang, Puning (CN)

(72) Inventor: Weitao Fang, Puning (CN)

( * ) Notice: Subject to any disclaimer, the term of this patent is extended or adjusted under 35 U.S.C. 154(b) by 0 days.

(21) Appl. No.: 19/218,565

(22) Filed: May 26, 2025

(30) Foreign Application Priority Data

Apr. 24, 2025 (CN) ..... 202520797392.2

(51) Int. Cl.
*A41G 1/00* (2006.01)

(52) U.S. Cl.
CPC ..... *A41G 1/00* (2013.01)

(58) Field of Classification Search
CPC ..... A41G 1/00
USPC ..... 428/24
See application file for complete search history.

(56) References Cited

U.S. PATENT DOCUMENTS 720,132 A * 2/1903 Green ..... A47G 7/07 47/41.11
4,293,997 A * 10/1981 Lee ..... A41G 1/00 29/458
6,389,718 B1 * 5/2002 Joo ..... A41G 1/002 40/412

FOREIGN PATENT DOCUMENTS

DE 2255696 A1 * 11/1972
GB 1024152 A * 3/1966 ..... A41G 1/00

OTHER PUBLICATIONS

English language translation of DE 2255696 A1, generated on Aug. 25, 2025 with Espacenet website (https://worldwide.espacenet.com/).*

Yeebay, "Yeebay Flower Garden Building Toys for Girls . . . " on Amazon.com; Available for public sale as early as Sep. 19, 2022, p. 1-11. Accessed at https://www.amazon.com/YEEBAY-Flower-Garden-Building-Girls/dp/B09FGGRQTD/ref=sr_1_1_sspa?crid=26KJEDGRHOXOU&dib=eyJ2ljoiMSJ9.Z9Q4r-TuV3Tv9MIEHwT4I_SS_xEc69RRWbH.*
Lv6EE_F0-gvgtMFxRH61AfB2CzJ1c2vqoTT_DSSUI8GfURNi2e212QNMK3a1rGMt6NNuWybKAas60bVmxnsJ2QTD0-7aRR814ZbV5GVMjExBPwOsSsiE4kwuBybSjga3gfc6QQ9qCkFSI2MU77J7fcaZkNGDTNsTTKkUiWbQYRNhqIPETYmkZfARouLSNhdQ67saxg03Pkl5sAg8FVn06gmNjDrZPs5LmM386Z5P76CrZR4WnOkAe-9GMi694B2YzXgAYrc.byMz3UC-muvO0d_E6j6QrRnl4-hxQHwDF1W4CU5.*
2a0s&dib_tag=se&keywords=YEEBAY+Flower+Garden+Building+Toys&qid=1756140456&s=toys-and-games&sprefix=yeebay+flower+garden+building+toys%2Ctoys-and-games%2C188&sr=1-1-spons&sp_csd=d2lkZ2VOTmFtZT1zcF9hdGY&psc=1.*

* cited by examiner

*Primary Examiner* — Humera N. Sheikh
*Assistant Examiner* — Julia L Rummel

(57) ABSTRACT

A craft flower is provided. The craft flower at least includes a leaf structure, a petal structure, and a stamen structure plugged in a cascading manner. Any two leaf structures are detachably connected by a connector. A plugging portion of the petal structure passes through the leaf structure and is detachably installed with a plugging piece. The plugging piece is configured to position and assemble the craft flower. It can be freely combined according to decorative requirements.

3 Claims, 8 Drawing Sheets

CRAFT FLOWER

RELATED APPLICATIONS

The present application claims the benefit of priority of Chinese Patent Application No. 202520797392.2, filed Apr. 24, 2025, and entitled "CRAFT FLOWER," the entire content of which is incorporated herein by reference.

TECHNICAL FIELD

The present application relates to the field of handicraft technology, and in particular to a craft flower.

BACKGROUND

Craft flowers are a kind of decoration. The basic shape of craft flowers is the same as that of fresh flowers. They are mainly composed of branches and leaves and flowers installed on the branches. Flowers include petals and flower cores. Generally speaking, the overall structure of existing craft flowers is integrated and cannot be recombined according to decorative needs, lacking the convenience for users to freely combine them.

SUMMARY

(I) Technical Problem

The purpose of the present application is to provide a craft flower to solve the problem that existing craft flowers cannot be freely combined according to decorative needs.

(II) Technical Solution

In order to achieve the above purpose, the present application provides the following technical solution:

A craft flower at least includes a leaf structure, a petal structure, and a stamen structure plugged in a cascading manner, any two leaf structures are detachably connected by a connector, a plugging portion of the petal structure passes through the leaf structure and is detachably installed with a plugging piece, and the plugging piece is configured to position and assemble the craft flower.

Preferably, the leaf structure includes a first connecting portion and at least two first blades arranged outside the first connecting portion and evenly distributed along a circumference, the first connecting portion is provided with a first mounting hole for plugging the petal structure, and a limiting convex ring is provided in the first mounting hole to limit the petal structure from falling out.

Preferably, the connector includes a first step structure provided at an end portion of one first blade, and a second step structure provided at an end portion of the other first blade; the first step structure has a same structure as the second step structure but has an opposite opening direction; the first step structure is provided with a connecting block protruding in the opening direction, the second step structure is provided with a connecting hole for clamping the connecting block.

Preferably, a side of the connecting block is provided with a first engaging portion protruding outward, and an inner wall of the connecting hole is provided with a first engaging groove that fits with the first engaging portion.

Preferably, the connector includes a connecting plate, and two end portions of the connecting plate are respectively provided with plugging holes plug-fitted to the first connecting portion; the first connecting portion is provided with a second engaging portion and a third engaging portion protruding outward, the height of the second engaging portion is greater than the height of the third engaging portion, and the second engaging portion and the third engaging portion are arranged in a staggered manner; the openings on both sides of the plugging hole are provided with a second engaging groove respectively fitted with the second engaging portion and a third engaging groove fitted with the third engaging portion.

Preferably, a second mounting hole is provided in the middle of the connecting plate, and the petal structure can be detachably plugged into the second mounting hole.

Preferably, the petal structure includes a plugging portion, multiple second blades evenly distributed along a circumference are provided at an upper end of the plugging portion, a perforated third mounting hole is opened on the plugging portion, and an engaging protrusion is provided in the third mounting hole; the bottom of the plugging portion is provided with a step portion inserted into the first mounting hole, an end portion of the step portion is provided with a limiting portion, and a diameter of the limiting portion is greater than an inner diameter of the limiting convex ring.

Preferably, the plugging piece includes a flower rod, an upper end portion of the flower rod is provided with a conical head inserted into the third mounting hole, and the flower rod is provided with multiple third blades arranged in a staggered manner.

Preferably, the plugging piece includes a limiting block and a connecting column protruding from the limiting block, and the connecting column is plug-fitted to the third mounting hole.

Preferably, the stamen structure includes a plugging rod and a stamen portion arranged on the plugging rod, a lower end of the plugging rod is provided with a limiting ball portion that allows inserting the third mounting hole, and a diameter of the limiting ball portion is greater than an inner diameter of the engaging protrusion.

Preferably, the craft flower includes a base, multiple support portions protruding are provided on the base, a fourth mounting hole is opened on the support portion, and a lower end of the flower rod is plugged into the fourth mounting hole.

Preferably, a side wall of the base extends from the top to the bottom and is inclined outward.

Preferably, the leaf structure, the petal structure and the stamen structure are all integrated injection-molding structures.

(III) Beneficial Effects

By forming the leaf structure, petal structure and stamen structure into a split independent structure, plugging them together in a cascading manner to assemble them into craft flowers, one or more of the three structures can be transformed according to different types of flower shapes to form a craft flower assembly method with multiple types of flower shapes;

moreover, the connection between the leaf structures is achieved through connectors, further realizing the combination of multiple craft flowers and satisfying stable connection; and in addition, adding a plugging piece to connect with the petal structure can realize plugging fixation without a leaf structure, plugging fixation can also be realized with a leaf structure, and a relatively fixed installation of the entire craft flower can be formed to meet corresponding decorative requirements.

BRIEF DESCRIPTION OF THE DRAWINGS

In FIG. 1 to FIG. 13, the relationship between the component names or lines and numerical references is as follows:

Figure 1:
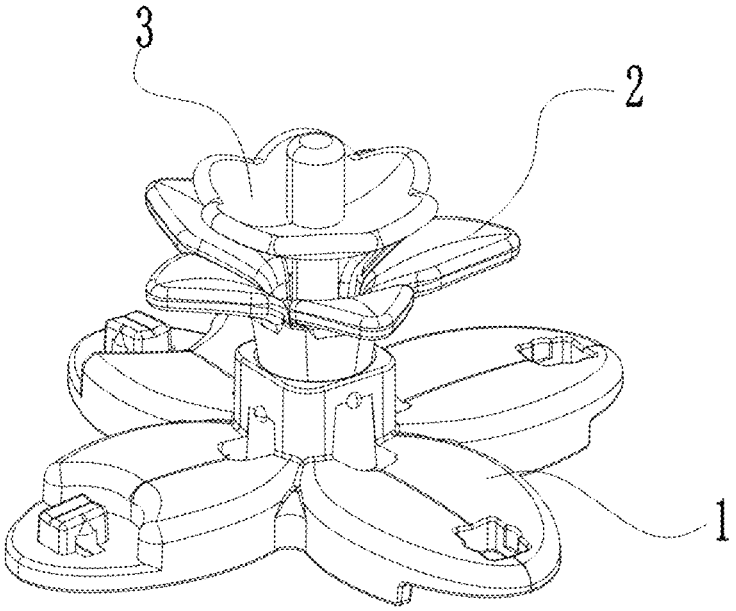
FIG. 1 is a structural schematic diagram of a craft flower according to an embodiment of the present application.

leaf structure 1, first connecting portion 101, first blade 102, first mounting hole 103, limiting convex ring 104, petal structure 2, plugging portion 21, second blade 22, third mounting hole 23, engaging protrusion 24, step portion 25, limiting portion 26, stamen structure 3, plugging rod 31, stamen portion 32, limiting ball portion 33, connector 4, first step structure 41, second step structure 42, connecting block 43, connecting hole 44, first engaging portion 45, first engaging groove 46, connecting plate 47, plugging hole 48, second engaging portion 49, third engaging portion 410, second engaging groove 411, third engaging groove 412, second mounting hole 413, plugging piece 5, flower rod 51, conical head 52, third blade 53, limiting block 54, connecting column 55, base 6, support portion 61, fourth mounting hole 62.

DETAILED DESCRIPTION

The technical solutions in embodiments of the present application will be clearly and completely described below with reference to the drawings in embodiments of the present application. Obviously, the embodiments described are only a part of, not all, the embodiments of the present application.

Figure 2:
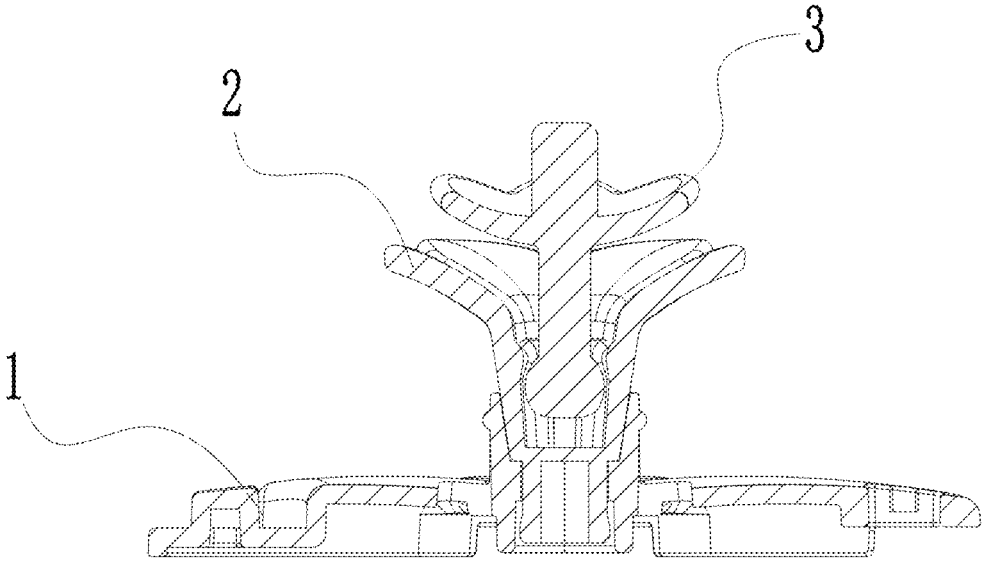
FIG. 2 is a cross-sectional structural schematic diagram of a craft flower according to an embodiment of the present application.

As shown in FIGS. 1-2, a craft flower is proposed in an embodiment of the present application, which at least includes a leaf structure 1, a petal structure 2, and a stamen structure 3 plugged in a cascading manner, in which the structural forms of the leaf structure 1, the petal structure 2 and the stamen structure 3 can be in different flower shapes, and a variety of combinations can be achieved by plugging in a cascading manner, for instance, the stamen structure 3 is plugged into the petal structure 2, and the petal structure 2 is plugged into the leaf structure 1; or the petal structure 2 is plugged into the stamen structure 3; or the stamen structure 3 is plugged into the petal structure 2 and other combinations, thereby being able to be combined into craft flowers of different forms.

Figure 7:
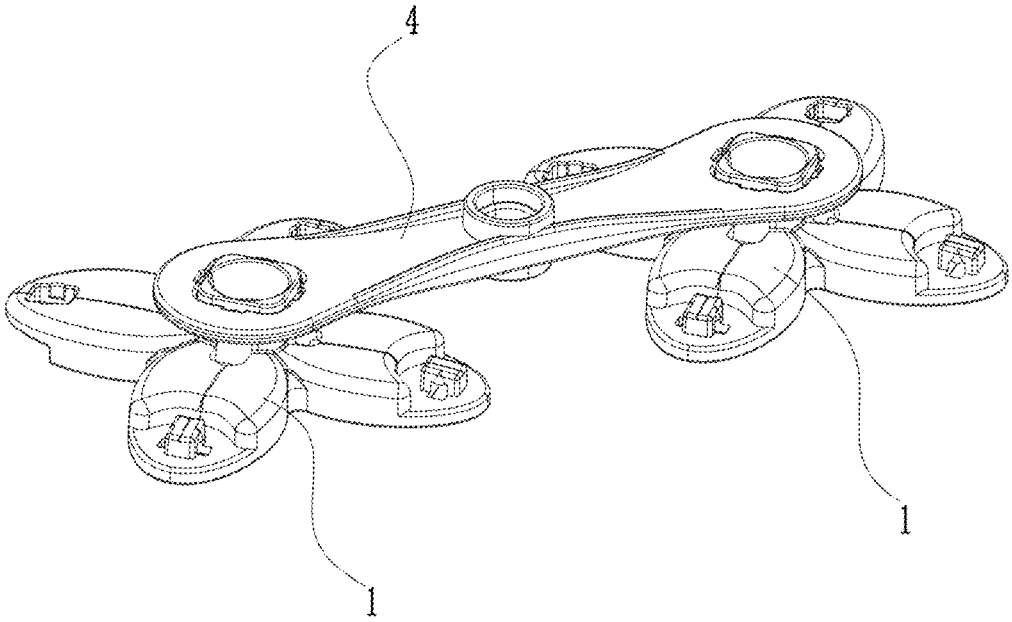
FIG. 7 is a schematic diagram of connecting a leaf structure through a second embodiment of a connector according to an embodiment of the present application.
Figure 8:
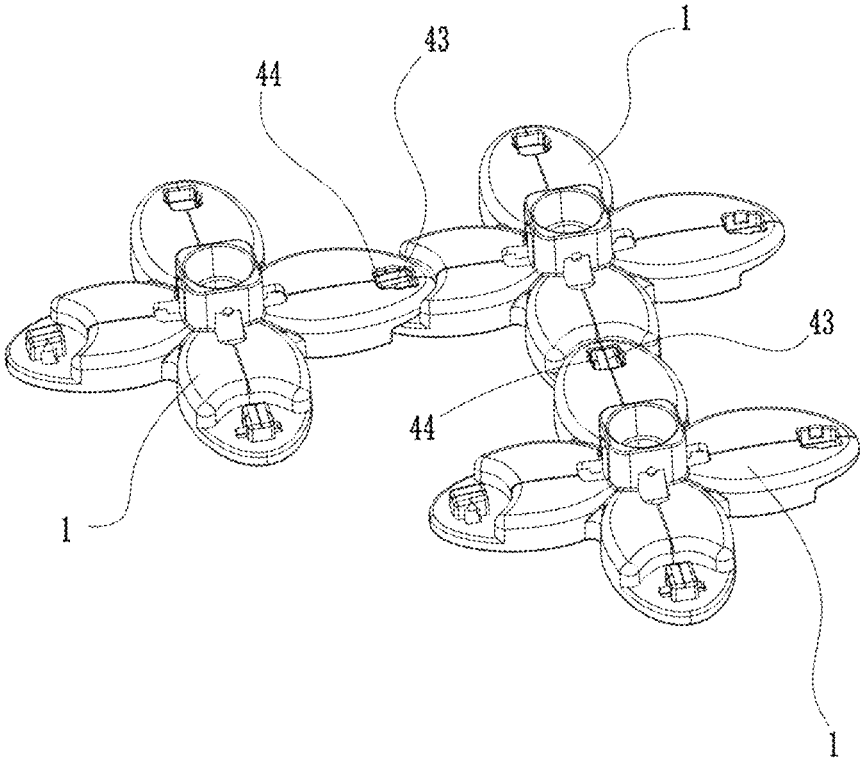
FIG. 8 is a schematic diagram of connecting a leaf structure through a first embodiment of a connector according to an embodiment of the present application.

A single craft flower be made into various forms, and multiple craft flowers can also be further combined. Specifically, any two leaf structures 1 are detachably connected by a connector 4. As shown in FIGS. 7 and 8, after connecting any two leaf structures 1 through the connector 4, a craft flower combination can be formed and stably connected.

Figure 9:
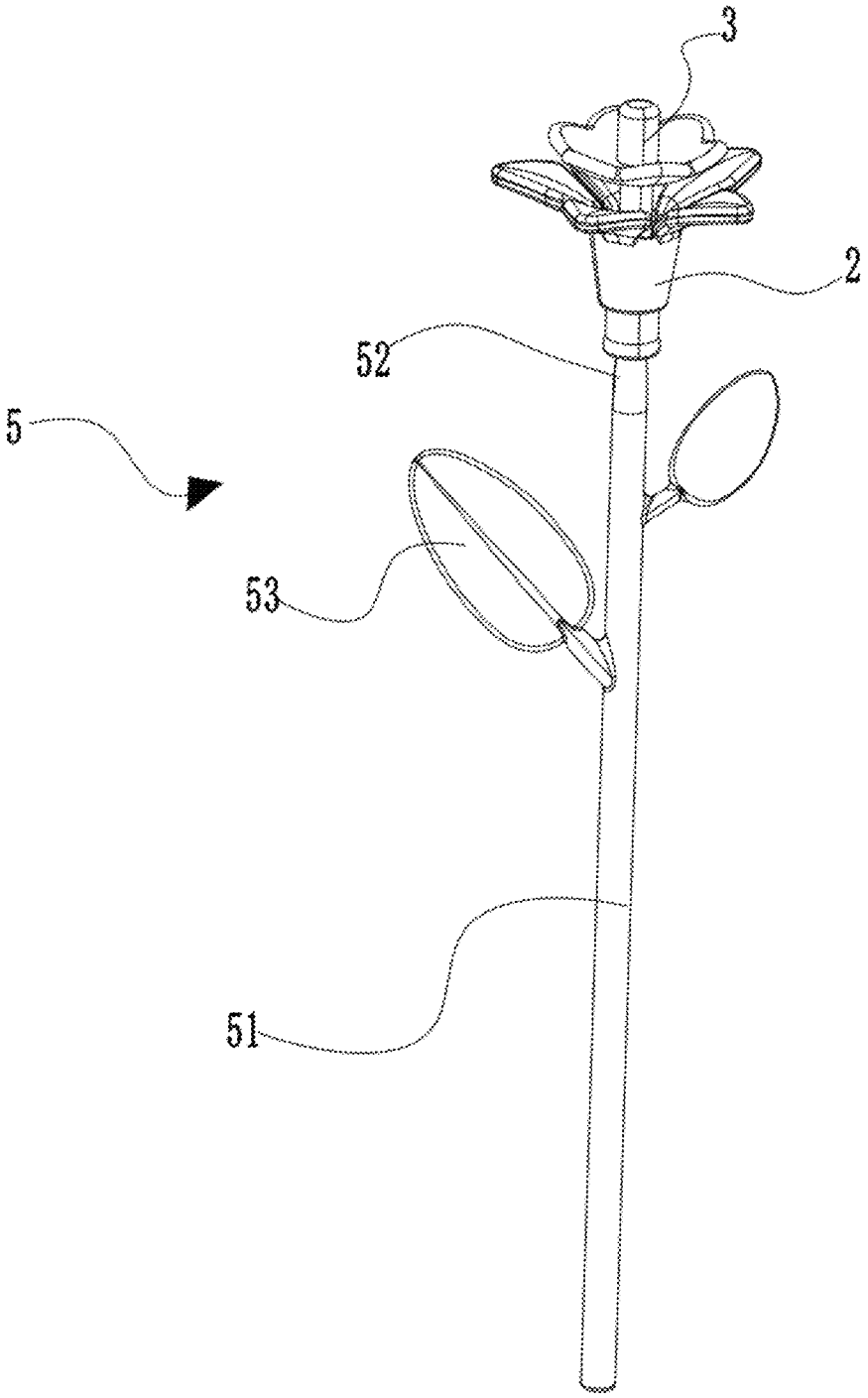
FIG. 9 is a schematic diagram of connecting a petal structure through a first embodiment of a plugging piece according to an embodiment of the present application.
Figure 10:
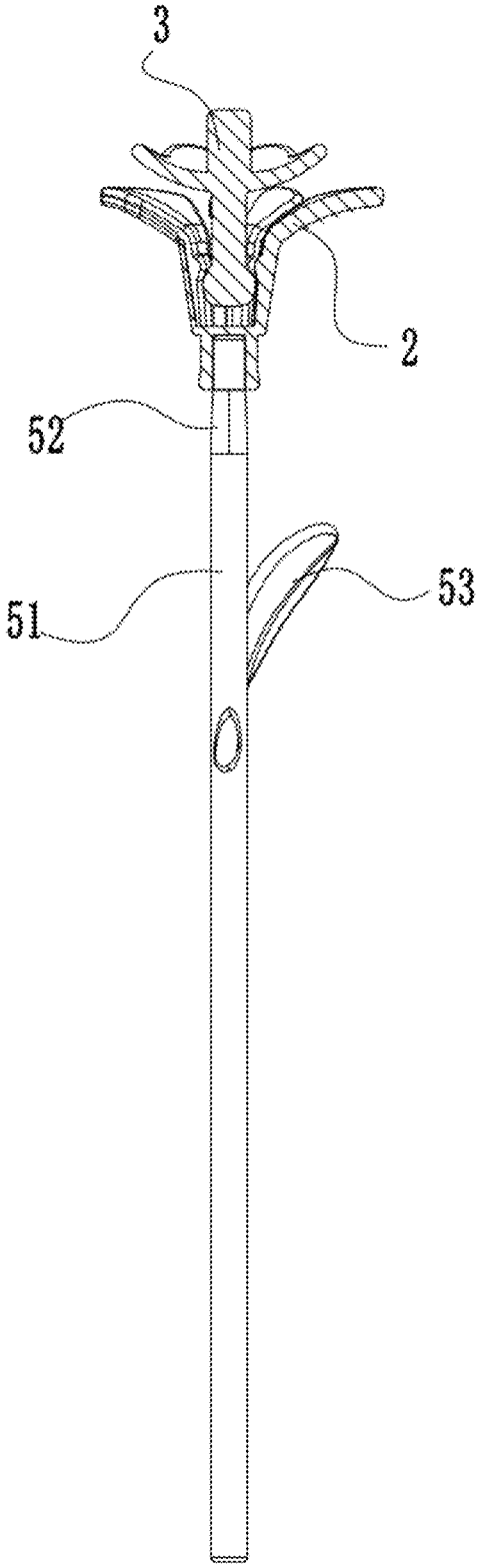
FIG. 10 is a cross-sectional schematic diagram of FIG. 9.
Figure 11:
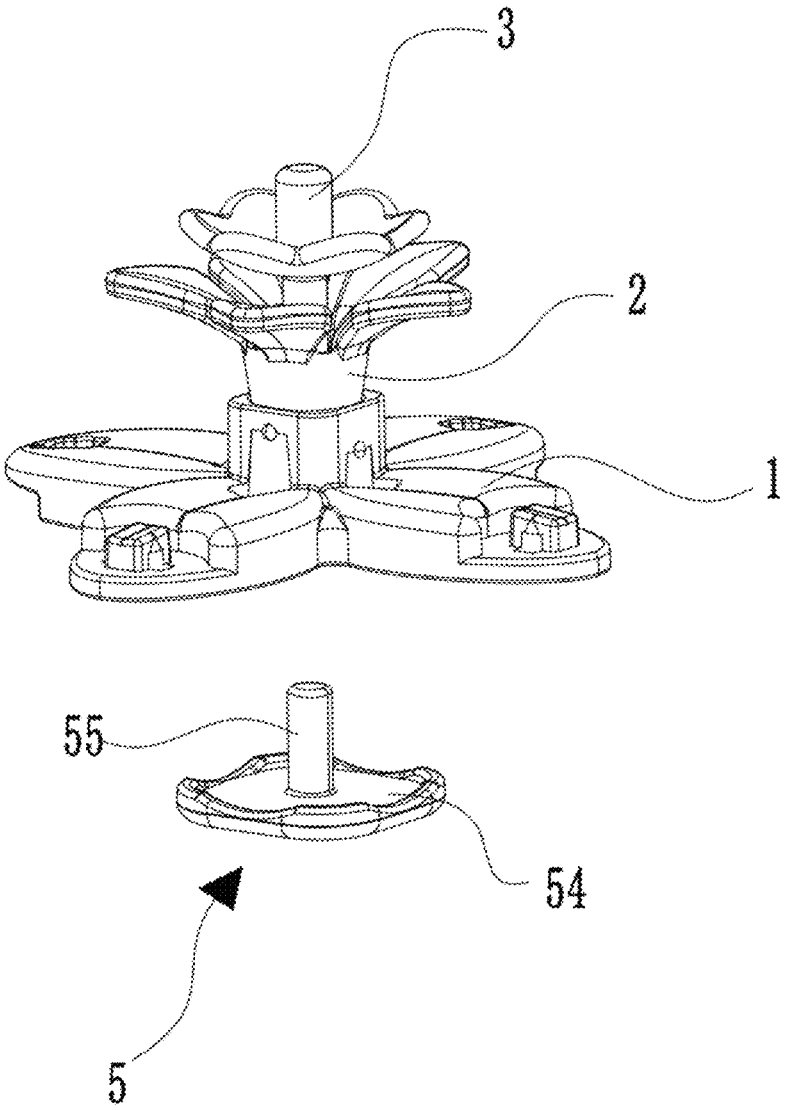
FIG. 11 is a schematic diagram of connecting a petal structure through a second embodiment of a plugging piece according to an embodiment of the present application.

Moreover, as shown in FIGS. 9, 10 and 11, a plugging portion 21 of the petal structure 2 passes through the leaf structure 1 and is detachably installed with a plugging piece 5. The plugging piece 5 is configured to position and assemble the craft flower. The plugging piece 5 forms mounting the craft flower by plugging according to decoration requirements, such as a state simulating that the craft flower is planted in the soil, a state that the craft flower is embroidered on a flat fabric such as cloth, and so forth, all of which are plugged and fixed in corresponding states by different forms of plugging pieces 5.

Thus, a free combination of various craft flower forms can be presented, which improves the convenience and fun of users in decorating craft flowers.

The leaf structure 1 form, petal structure 2 form and stamen structure 3 form specifically constructed in this embodiment can be formed according to different flower shapes without limitation.

Figure 3:
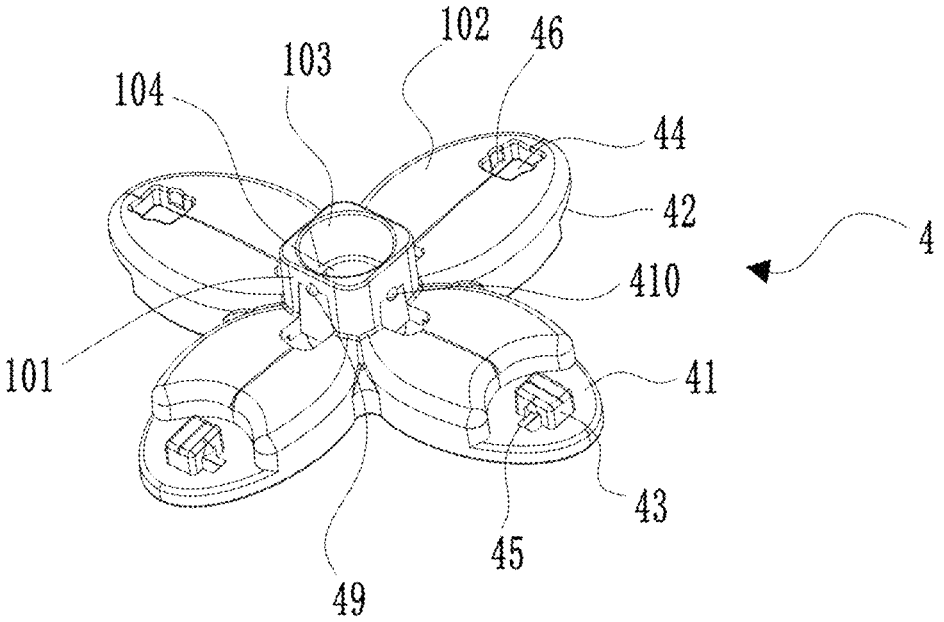
FIG. 3 is a structural schematic diagram of a leaf structure according to an embodiment of the present application.

Here, as shown in FIG. 3, the leaf structure 1 includes a first connecting portion 101 and at least two first blades 102 arranged outside the first connecting portion 101 and evenly distributed along a circumference, the first connecting portion 101 is provided with a first mounting hole 103 for plugging the petal structure 2, and a limiting convex ring 104 is provided in the first mounting hole 103 to limit the petal structure 2 from falling out; the number of the first blades 102 is at least two, it can also be three, four, and so forth, and the specific number depends on the flower shape. The first mounting hole 103 is configured to plug-fit the petal structure 2, in which the limiting convex ring 104 is provided to form an anti-falling limit after the petal structure 2 is plugged in.

The connector 4 is configured to detachably connect any two leaf structures 1, so that a stable connection can be made when the craft flowers are combined, and multiple options are available to the connector 4 according to the combination form.

In an embodiment, as shown in FIG. 3, the connector 4 includes a first step structure 41 provided at an end portion of one first blade 102, and a second step structure 42 provided at an end portion of the other first blade 102; the first step structure 41 has a same structure as the second step structure 42 but has an opposite opening direction; the first step structure 41 is provided with a connecting block 43 protruding in the opening direction, and the second step structure 42 is provided with a connecting hole 44, and the cross-sectional shape of the connecting block 43 is the same as that of the connecting hole 44; the first step structure 41 with an opposite opening direction fits with the second step structure 42 to ensure that the connected leaf structures 1 are flush with each other, and at the same time, the connecting block 43 is inserted into the connecting hole 44 to form a limit, thereby ensuring a stable connection state between the leaf structures 1.

The structure formed by the connector 4 is integrated on the leaf structure 1, which can facilitate synchronous molding when the leaf structure 1 is molded, and has good structural strength and stability.

In order to ensure that the connecting block 43 has an anti-detachment effect after being plugged into the connecting hole 44, a side of the connecting block 43 is provided with a first engaging portion 45 protruding outward, and an inner wall of the connecting hole 44 is provided with a first engaging groove 46 that fits with the first engaging portion 45. After the first engaging portion 45 and the first engaging groove 46 are engaged, the connecting block 43 is limited and will not be disengaged from the connecting hole 44 without external force.

Thus, in the above embodiment, the connection combination between any two leaf structures 1 is achieved by connection through end portions of the first blade 102.

Figure 6:
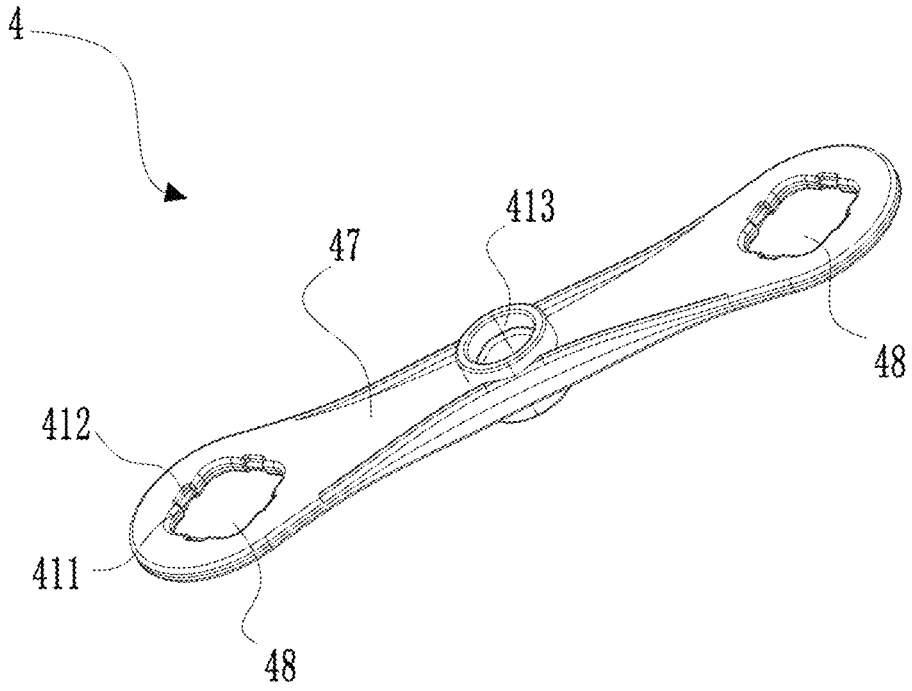
FIG. 6 is a structural schematic diagram of a second embodiment of a connector according to an embodiment of the present application.

In another embodiment, the connector 4 is an independent part, as shown in FIG. 6, specifically including a connecting plate 47, and two end portions of the connecting plate 47 are respectively provided with plugging holes 48 plug-fitted to the first connecting portion 101; the first connecting portion 101 is provided with a second engaging portion 49 and a third engaging portion 410 protruding outward, the height of the second engaging portion 49 is greater than the height of the third engaging portion 410, and the second engaging portion 49 and the third engaging portion 410 are arranged in a staggered manner. Moreover, the openings on both sides of the plugging hole 48 are provided with a second engaging groove 411 respectively fitted with the second engaging portion 49 and a third engaging groove 412 fitted with the third engaging portion 410; the plugging hole 48 on the connecting plate 47 is sleeved on the first connecting portion 101 to form a connection to the leaf structure 1. Moreover, by adjusting the height and staggered arrangement of the first engaging portion 45 and the second engaging portion 49, it is possible to achieve a method in which any two leaf structures 1 can be connected at the same height or with a height difference, and thanks to the staggered arrangement, the angle and position of the leaf structure 1 after connection can be adjusted.

Here, the first engaging portion 45 and the second engaging portion 49 are both convex, and have an anti-falling function after being fitted with the second engaging groove 411 and the third engaging groove 412 in the corresponding position direction. Specifically, there is a thin wall between the second engaging groove 411 and the third engaging groove 412, and the thin wall has a limiting effect on the first engaging portion 45 and the second engaging portion 49, and they can only be separated when external force is applied.

Therefore, any two leaf structures 1 that are far apart can be combined and connected through the connecting plate 47, and a second mounting hole 413 is provided in the middle of the connecting plate 47. The petal structure 2 can be detachably plugged into the second mounting hole 413 to further increase the morphological display of the flower arrangement.

Figure 4:
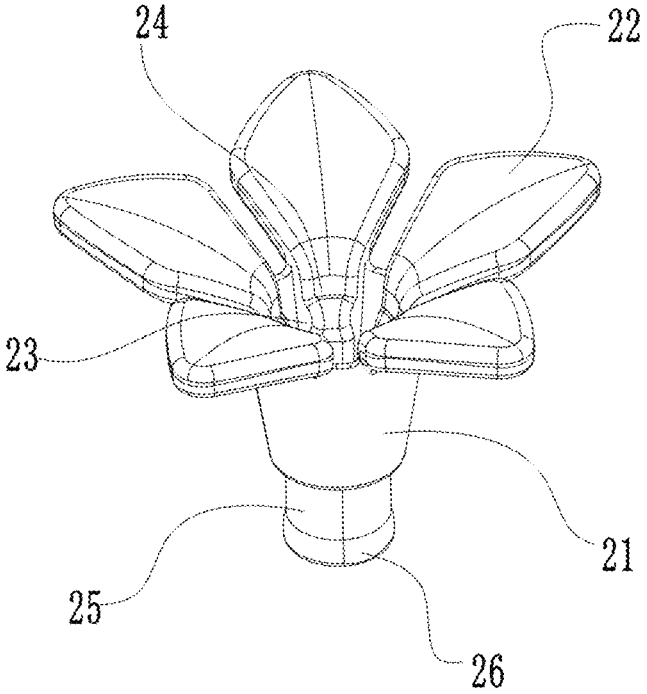
FIG. 4 is a structural schematic diagram of a petal structure according to an embodiment of the present application.

The petal structure 2 can also be formed according to different flower shapes, the petal structure 2 can be plugged into the leaf structure 1 or independently plugged into the plugging piece 5, and the stamen structure 3 can be plugged into the petal structure 2. Specifically, as shown in FIG. 4, the petal structure 2 includes a plugging portion 21, multiple second blades 22 evenly distributed along a circumference are provided at an upper end of the plugging portion 21, a perforated third mounting hole 23 is opened on the plugging portion 21, and an engaging protrusion 24 is provided in the third mounting hole 23. The third mounting hole 23 is configured to plug the stamen structure 3, and the engaging protrusion 24 limits the state of the stamen structure 3 after plugging in to prevent it from falling off.

Moreover, the bottom of the plugging portion 21 is provided with a step portion 25 inserted into the first mounting hole 103, an end portion of the step portion 25 is provided with a limiting portion 26, and a diameter of the limiting portion 26 is greater than an inner diameter of the limiting convex ring 104. The entire plugging portion 21 can be inserted into the first mounting hole 103, in which the step portion 25 can pass through the position of the limiting convex ring 104 and form an anti-detachment by making the diameter of the limiting portion 26 larger than the inner diameter of the limiting convex ring 104.

The plugging piece 5 is inserted into the third mounting hole 23 to form a support, and the plugging piece 5 further has two embodiments depending on the mounting state.

In one embodiment, as shown in FIGS. 9 and 10, the plugging piece 5 includes a flower rod 51, an upper end portion of the flower rod 51 is provided with a conical head 52 inserted into the third mounting hole 23, and the flower rod 51 is provided with multiple third blades 53 arranged in a staggered manner; the craft flowers are assembled in a flower arrangement state through the flower rod 51, in which the conical head 52 forms an interference fit after being plugged into the third mounting hole 23, the plugging stability is ensured, and the third blade 53 forms a decoration on the flower rod 51, so that the craft flower after the flower rod 51 is plugged in can better present the shape of a flower.

Figure 12:
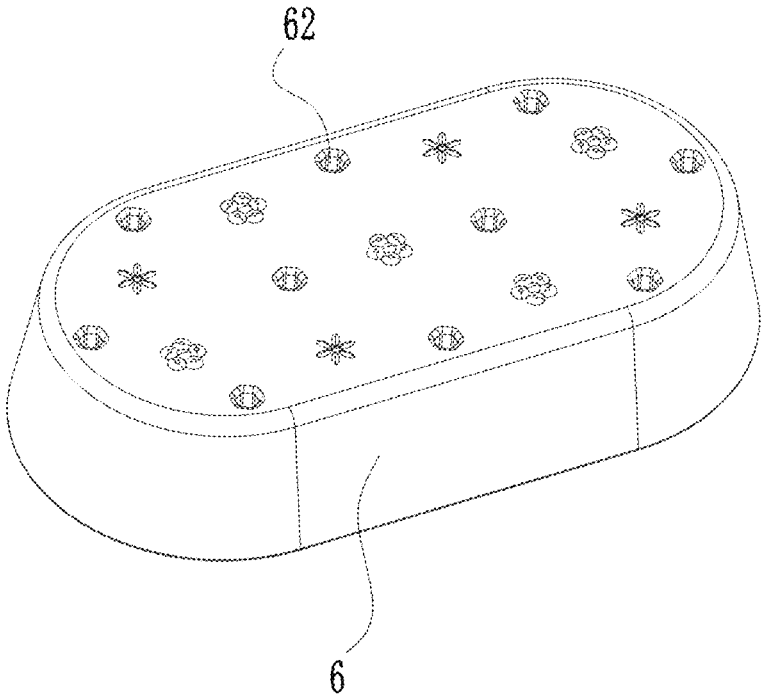
FIG. 12 is a schematic diagram of a first perspective structure of a base according to an embodiment of the present application.
Figure 13:
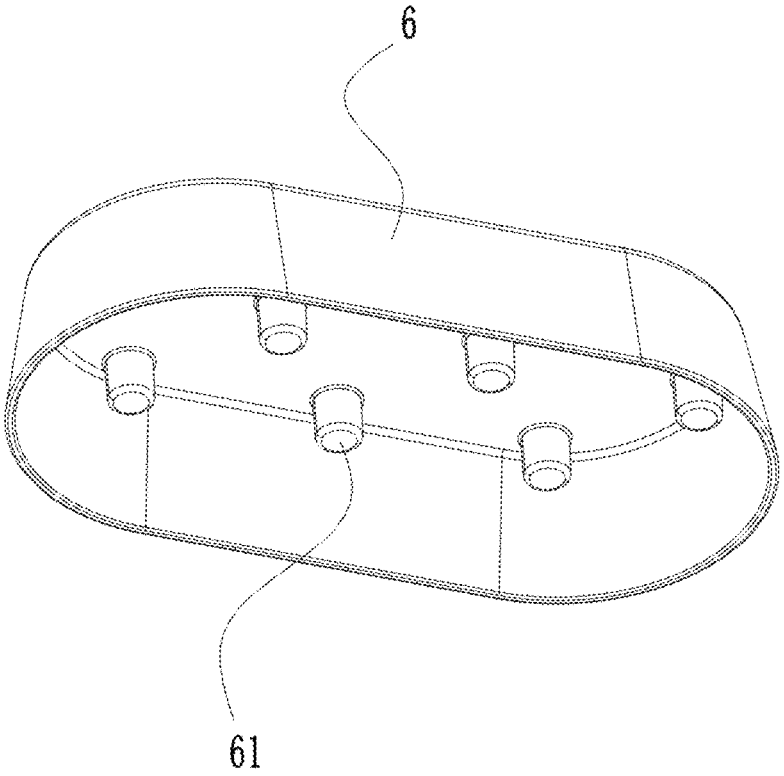
FIG. 13 is a schematic diagram of a second perspective structure of a base according to an embodiment of the present application.

Moreover, in order to facilitate the relatively stable plugging of the finished craft flowers, as shown in FIGS. 12 and 13, the craft flower further includes a base 6, multiple support portions 61 protruding are provided at the bottom wall of the base 6, multiple fourth mounting holes 62 are opened on the base 6, some fourth mounting holes 62 extend into the support portion 61, a lower end of the flower rod 51 is plugged into the fourth mounting hole 62, and a support is formed by the base 6 and a vertical support for the craft flower is formed after the lower end of the flower rod 51 is plugged into the fourth mounting hole 62.

In order to ensure the stability of the placement of the base 6, a side wall of the base 6 extends from the top to the bottom and is inclined outward, so that the bottom surface area of the base 6 is larger than the top surface area, and the placement state is more stable.

In another embodiment, the craft flower can also be assembled on cloth or other flat objects to form decoration. Specifically, as shown in FIG. 11, the plugging piece 5 includes a limiting block 54 and a connecting column 55 protruding from the limiting block 54, and the connecting column 55 is plug-fitted to the third mounting hole 23 to form a limiting effect through the limiting block 54. After being inserted into the third mounting hole 23 through the connecting column 55, the craft flower and the limiting block 54 are pressed against the cloth or other flat objects, thereby fixing the craft flower on the cloth or other flat objects.

Therefore, different plugging pieces 5 can be selected for matching application according to needs during specific decoration of craft flowers.

Figure 5:
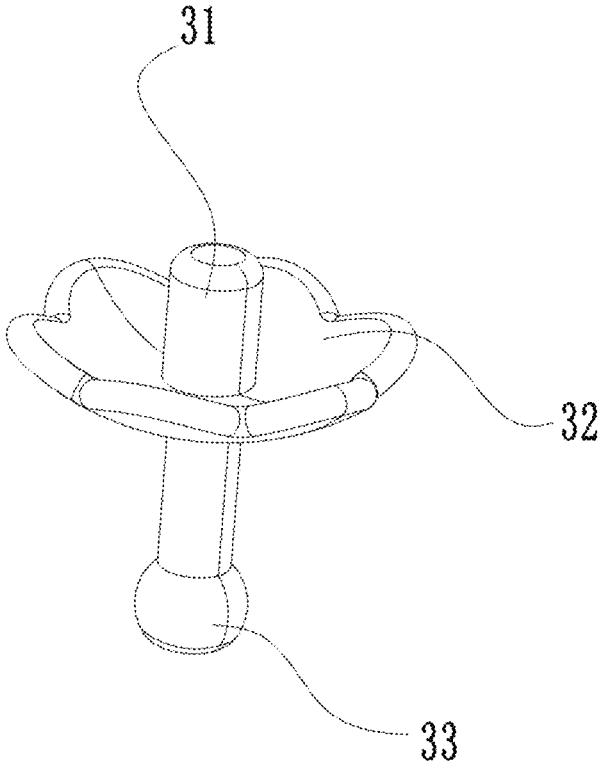
FIG. 5 is a structural schematic diagram of a stamen structure according to an embodiment of the present application.

Specifically, as shown in FIG. 5, the stamen structure 3 can further be formed according to different flower types and made in a variety of forms. The stamen structure 3 includes a plugging rod 31 and a stamen portion 32 arranged on the plugging rod 31, a lower end of the plugging rod 31 is provided with a limiting ball portion 33 that allows inserting the third mounting hole 23, and a diameter of the limiting ball portion 33 is greater than an inner diameter of the engaging protrusion 24. The stamen portion 32 is configured to present the stamen shapes of different flowers, while the plugging rod 31 is configured to realize that the stamen structure 3 is plugged into the third mounting hole 23 of the petal structure 2, and forms a reverse anti-detachment limit after passing through the engaging protrusion 24 through the limiting ball portion 33, ensuring that the stamen structure 3 is reliably plugged and fixed on the petal structure 2.

In order to facilitate batch processing of the leaf structure 1, petal structure 2, stamen structure 3, flower stem 51, and base 6, an integrated injection-molding structure can be used, and different colors can be provided according to needs.

In the present application, unless otherwise specified or restricted, the terms of "installation", "interconnection", "connection" and "fixing" shall be understood as a general sense. For example, the connection can be fixed connection, removable connection, integrated connection, mechanical connection, electrical connection, direct connection, indirect connection through intermediate media, connection between two components or interaction between two components. Persons of ordinary skill in the art can understand the specific meanings of the above terms in the present application as appropriate.

In the description of the present application, it needs to be noted that the azimuth or position relationships indicated by the terms "center", "upper", "lower", "left", "right", "inside" and "outside" are based on those shown in the drawings, or those in which a product of the present application is usually placed when used. It is only for convenience of description and simplification of the present application, not to indicate or imply that the referred devices or components must have a specific orientation, be constructed and operate in a specific orientation, and thus cannot be understood as limiting the present application. Furthermore, the terms "first" and "second" are used merely for distinguishing purposes and shall not be construed as indicating or implying relative importance.

It is obvious to those skilled in the art that the present application is not limited to the details of the above exemplary embodiment, and can be implemented in other specific forms without departing from the spirit or basic features of the present application. Therefore, no matter from which point of view, the embodiment should be regarded as exemplary and non-limiting. The scope of the present application is defined by the claims rather than the above description, so it is intended to include all changes that fall within the meaning and scope of the equivalent elements of the claims in the present application. Any reference numerals in the claims should not be regarded as limiting the claims involved.

What is claimed is:

1. A craft flower, comprising a leaf structure, a petal structure, a stamen structure, a plugging piece, and a base, wherein the petal structure has a plugging portion that is detachably installed with the plugging piece, the plugging piece being configured to position and assemble the craft flower;

wherein the leaf structure comprises a first connecting portion and at least two first blades arranged outside the first connecting portion and evenly distributed along a circumference of the first connecting portion, the first connecting portion is provided with a first mounting hole for receiving the petal structure, and a limiting convex ring is provided in the first mounting hole to limit the petal structure from falling out;

wherein multiple second blades are provided at an upper end of the plugging portion and are evenly distributed along a circumference of the plugging portion, a perforated third mounting hole is opened on the plugging portion, and an engaging protrusion is provided in the third mounting hole, the engaging protrusion defining a restricted passage within the third mounting hole; the bottom of the plugging portion is provided with a step portion inserted into the first mounting hole, an end portion of the step portion is provided with a limiting portion, and a diameter of the limiting portion is greater than an inner diameter of the limiting convex ring;

wherein the stamen structure comprises a plugging rod and a stamen portion arranged on the plugging rod, a lower end of the plugging rod is provided with a limiting ball portion, and a diameter of the limiting ball portion is greater than a diameter of the restricted passage to retain the plugging rod within the third mounting hole;

wherein multiple support portions are provided at a bottom wall of the base, and multiple fourth mounting holes are opened on the base, wherein some of the fourth mounting holes extend into the support portions;

wherein the plugging piece comprises a flower rod, and a lower end of the flower rod is plugged into one of the fourth mounting holes; and wherein a side wall of the base extends from a top of the base to a bottom of the base and is inclined outward, such that a bottom surface area of the base is larger than a top surface area of the base.

2. The craft flower according to claim 1, wherein an upper end portion of the flower rod is provided with a conical head inserted into the third mounting hole, and the flower rod is provided with multiple third blades arranged in a staggered manner.

3. The craft flower according to claim 2, wherein the leaf structure, the petal structure and the stamen structure are each an integrated injection-molding structure.

* * * * *